US012686585B2

(12) United States Patent
Nelson et al.

(10) Patent No.: US 12,686,585 B2
(45) Date of Patent: Jul. 21, 2026

(54) ORTHOGONAL PACKING MATERIAL DISPENSER

(71) Applicant: Encore Packaging LLC, Lake Villa, IL (US)

(72) Inventors: Stephenson Nelson, Gurnee, IL (US); Timothy H. Nelson, Winnetka, IL (US)

(73) Assignee: ENCORE PACKAGING LLC, Lake Villa, IL (US)

( * ) Notice: Subject to any disclaimer, the term of this patent is extended or adjusted under 35 U.S.C. 154(b) by 227 days.

(21) Appl. No.: 18/581,715

(22) Filed: Feb. 20, 2024

(65) Prior Publication Data

US 2024/0417204 A1 Dec. 19, 2024

Related U.S. Application Data

(60) Provisional application No. 63/508,630, filed on Jun. 16, 2023.

(51) Int. Cl.

| | |
|---|---|
| ***B65H 35/00*** | (2006.01) |
| ***B65H 16/02*** | (2006.01) |
| ***B65H 19/18*** | (2006.01) |

(52) U.S. Cl.

CPC ..... *B65H 35/0006* (2013.01); *B65H 16/028* (2013.01); *B65H 19/1873* (2013.01); *B65H 2701/1944* (2013.01)

(58) Field of Classification Search

USPC ..... 242/404.2

See application file for complete search history.

(56) References Cited

U.S. PATENT DOCUMENTS

| | | | | |
|---|---|---|---|---|
| 2,017,176 | A † | 10/1935 | Andrews | |
| 3,105,622 | A | 10/1963 | Waltz | |
| D197,623 | S | 3/1964 | Fulton | |
| 3,222,972 | A | 12/1965 | Fulton | |
| 3,236,427 | A | 2/1966 | Martin | |
| 3,339,797 | A * | 9/1967 | Knutson | B65C 11/00 221/73 |
| 3,813,849 | A | 6/1974 | Stambera | |
| 4,246,817 | A | 1/1981 | Marsh | |
| 5,219,126 | A * | 6/1993 | Schutz | A47K 10/3818 206/390 |

(Continued)

OTHER PUBLICATIONS

USPTO; U.S. Appl. No. 18/581,780; Office Action mailed Aug. 6, 2025; 25 pages.

(Continued)

*Primary Examiner* — William A. Rivera

(74) *Attorney, Agent, or Firm* — FITCH EVEN TABIN & FLANNERY, LLP

(57) ABSTRACT

A packing dispenser may include a face plate including a spout having a conical shape, first side walls connected to the face plate, a first roll shelf including a first base connected to the first side walls, a second roll shelf substantially orthogonal to the first roll shelf including a connecting plate, a second base, and second side walls and the connecting plate connects the second roll shelf to the first base of the first roll shelf. The paper dispenser allows for multiple rolls of packing material to be placed inside and interconnected such that multiple rolls can be used in the dispenser before more rolls of packing material are needed.

20 Claims, 6 Drawing Sheets

(56) References Cited

U.S. PATENT DOCUMENTS

| | | | | |
|---|---|---|---|---|
| D337,464 | S | 7/1993 | Giugiaro | |
| 6,145,782 | A | 11/2000 | King | |
| 6,199,788 | B1 | 3/2001 | Simhaee | |
| 6,328,252 | B1 | 12/2001 | Neveu | |
| 8,641,591 | B2 * | 2/2014 | Wetsch | B31D 5/0052 493/464 |
| 9,894,994 | B2 * | 2/2018 | Raid | A47B 88/493 |
| 9,937,682 | B2 * | 4/2018 | Schmid | B31D 5/0039 |
| D836,954 | S | 1/2019 | Turner | |
| 10,364,112 | B2 * | 7/2019 | Giesen | B65H 16/005 |
| 10,696,002 | B2 † | 6/2020 | Mulvey | |
| 11,225,043 | B2 * | 1/2022 | Schalk | B65B 41/12 |
| D1,011,072 | S | 1/2024 | Sklenar | |
| 12,060,180 | B2 † | 8/2024 | Goodrich | |
| D1,075,345 | S | 5/2025 | Stam | |
| D1,075,346 | S | 5/2025 | Guo | |
| D1,106,293 | S | 12/2025 | Nelson | |
| 2008/0125300 | A1 † | 5/2008 | Cheich | |
| 2009/0026306 | A1 * | 1/2009 | Kempster | B65H 20/26 242/593 |
| 2010/0314485 | A1 † | 12/2010 | Anderson | |
| 2011/0041461 | A1 | 2/2011 | Nelson | |
| 2013/0175311 | A1 | 7/2013 | Soucek | |
| 2014/0274647 | A1 * | 9/2014 | Wetsch | B31D 5/0043 493/464 |
| 2015/0048135 | A1 | 2/2015 | Bredahl | |
| 2015/0216377 | A1 | 8/2015 | Larsson | |
| 2017/0305652 | A1 * | 10/2017 | Giesen | B65D 85/671 |
| 2020/0147918 | A1 * | 5/2020 | Schalk | B65H 19/12 |
| 2020/0282687 | A1 | 9/2020 | Schalk | |
| 2021/0245908 | A1 * | 8/2021 | Goodrich | B65H 49/08 |
| 2024/0351818 | A1 | 10/2024 | Berdan | |
| 2024/0417200 | A1 | 12/2024 | Nelson | |
| 2024/0417204 | A1 | 12/2024 | Nelson | |

OTHER PUBLICATIONS

Encore Packaging LLC, (date retrieved Jun. 11, 2025), Center Pull Paper Dispenser, Encorepack.com, URL: (https://www.encorepack.com/ourproduct.php?sku=EP-5957-BM), (Year: 2025).

USPTO; U.S. Appl. No. 29/928,106; Office Action mailed Jun. 18, 2025; 7 pages.

PaperSpace Coreless e+ web page; https://www.itape.com/product/paperspace-coreless-e/; First Accessed Apr. 3, 2025; 1 page.

ShorrExpress Paper Void Fill Systems web page, https://www.shorr.com/packaging-products/protective-packaging-products/shorrexpress-paper-void-fill-systems/, First Accessed Apr. 3, 2025; 2 pages.

3rd Party submission filed in U.S. Appl. No. 18/581,715 mailed Mar. 28, 2025; 53 pages.

3rd Party submission filed in U.S. Appl. No. 18/581,780 mailed Apr. 9, 2025; 24 pages.

Email exchange between the Applicant and a Third Party dated Mar. 16, 2023, titled "Paper Dispenser Designs".

Email exchange between the Applicant and a Third Party dated Feb. 3, 2023.

Email exchange between the Applicant and a Third Party dated Mar. 17, 2023.

Email exchange between a Third Party and the Applicant dated Mar. 16, 2023.

Text Messages between inventor Tim Nelson (messages on the right hand side of the page, white text on a background) and a Third Party, Phil Reid, (messages on the left side of the page, black text) dating between Feb. 3, 2023, to Mar. 2, 2023 (Partially Redacted); p. 547 to 602.

Text Messages between inventor Tim Nelson (messages on the right hand side of the page, white text on a background) and a Third Party, Phil Reid, (messages on the left side of the page, black text) dating between Mar. 2, 2023, to Apr. 5, 2023 (Partially Redacted); p. 603 to 640.

Text Messages between inventor Tim Nelson (messages on the right hand side of the page, white text on a background) and a Third Party, Phil Reid, (messages on the left side of the page, black text) dating between Apr. 5, 2023, to, May 4, 2023 (Partially Redacted); p. 641 to 668.

Text Messages between inventor Tim Nelson (messages on the right hand side of the page, white text on a background) and a Third Party, Phil Reid, (messages on the left side of the page, black text) dating between May 3, 2023, to, Jun. 5, 2023 (Partially Redacted); p. 669 to 677.

Text Messages between inventor Tim Nelson (messages on the right hand side of the page, white text on a background) and a Third Party, Phil Reid, (messages on the left side of the page, black text) dating between Jun. 5, 2023, to, Jun. 19, 2023 (Partially Redacted); p. 678 to 710.

USPTO; U.S. Appl. No. 63/508,630; Provisional Application filed Jun. 16, 2023, entitled " Orthogonal Packing Material Dispenser"; 14 pages.

Benchmark Industrial; "HoneyPack BuzzPro3 Paper Dispenser, Desktop Mounted" , website at https://www.benchmarkinc.com/honeypack-buzz-pro-3-single-station-w-adjustable-length-bm3100.html, Gahanna, Ohio, 1 page. Available at least as early as Jan. 18, 2024.

HONEYPACK; "Paper Dunnage Systems", website at https://honeypack.com/paper-dunnage-systems/, Gahanna, Ohio, 1 page. Available at least as early as Jan. 18, 2024.

Center Pull Kraft Paper Dispenser Table Top System, available Jan. 6, 2026, [online], [site visited Jan. 8, 2026]. Available from internet, URL: https://encorepack.com/items/7274 (Year: 2026).

Encore Packaging, Date Not Available, [online], [site visited Jan. 8, 2026]. Available from internet, URL: https://encorepack.com/category/Material%20Dispensers%20%26%20Holders/Kraft%20Paper%20Dispensers (Year: 2026).

Encore Packaging LLC, (date retrieved Jun. 25, 2025), Center Pull Paper Dispenser with Bearings, Encorepack.com, URL: (https://www.encorepack.com/ourproduct.php?sku=EP-5959), (Year: 2025).

Shorr Packaging Corp., ShorrExpress® Paper Void Fill Systems, Pregis ShorrExpress EasyPack® Tablemate, 2025, 2 pages, https://www.shorr.com/packaging-products/protective-packaging-products/shorrexpress-paper-void-fill-systems/.†

IPG, Paperspace Coreless e+, 2025, 2 pages.†

* cited by examiner
† cited by third party

ORTHOGONAL PACKING MATERIAL DISPENSER

CROSS-REFERENCE TO RELATED APPLICATION

This application claims the benefit of priority to U.S. Provisional Application No. 63/508,630, filed Jun. 16, 2023, entitled ORTHOGONAL PACKING MATERIAL DISPENSER, the contents of which is incorporated by reference in its entirety herein.

TECHNICAL FIELD

This disclosure relates generally to an orthogonal packing material dispenser, and more specifically, to a packing material dispenser utilizing interconnected rolls of packing material.

BACKGROUND

The packing industry uses a variety of materials to secure items for shipping. Packing material dispensers aid in storing and dispensing of packing materials, such as rolls of kraft paper, for ease of access and ease of use for a user packing a package. Such material dispensers, however, are typically limited in the number of rolls of material that can be held such that a user may be interrupted during a packing operation by running out of material. Material dispensers holding more material, however, can often be of sufficient size to not be conveniently located for use during packaging operations.

BRIEF DESCRIPTION OF THE DRAWINGS

Disclosed herein are embodiments of apparatuses pertaining to packing material dispensers including and/or utilizing an orthogonal configuration and interconnected rolls of packing material. This description includes drawings, wherein.

Figure 1:
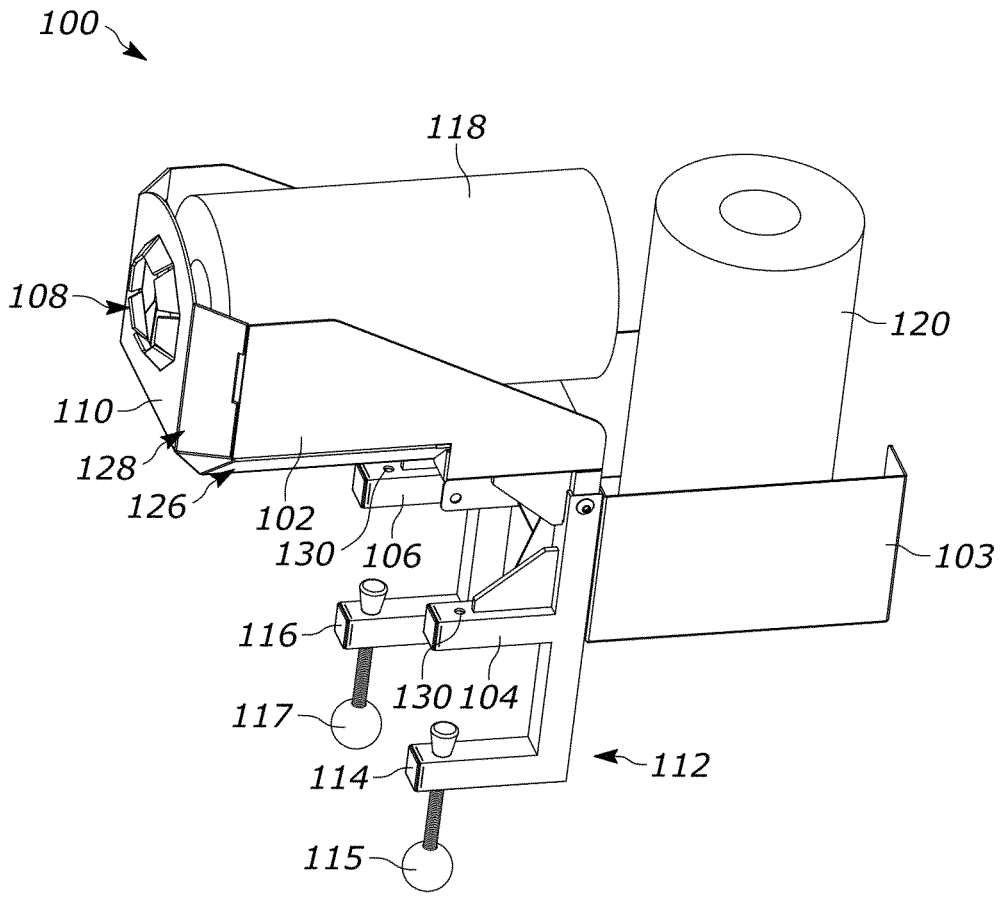
FIG. 1 is a perspective view of a packaging material holder in accordance with various embodiments.
Figure 2:
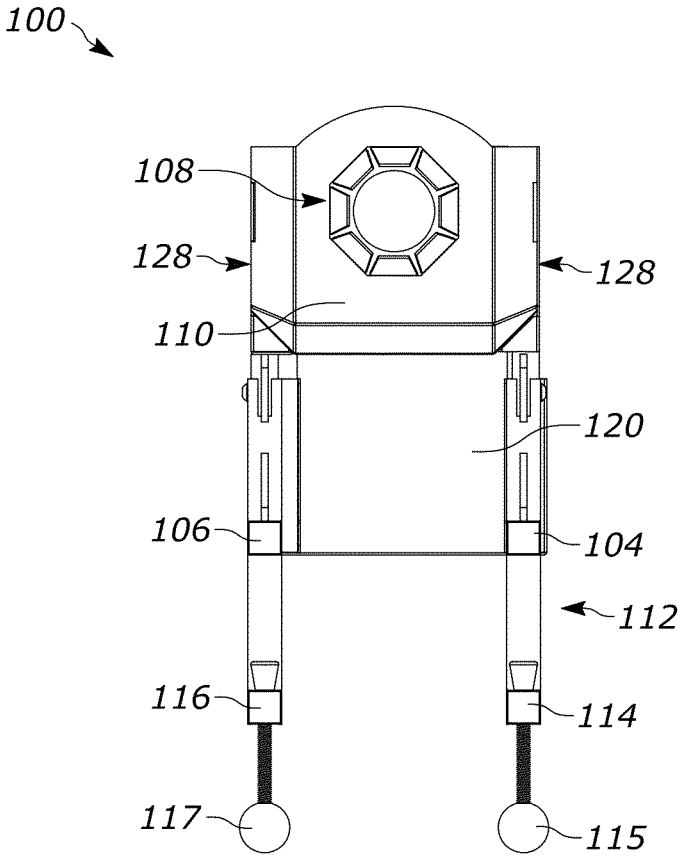
FIG. 2 is a front view of a packing material dispenser in accordance with various embodiments.
Figure 3:
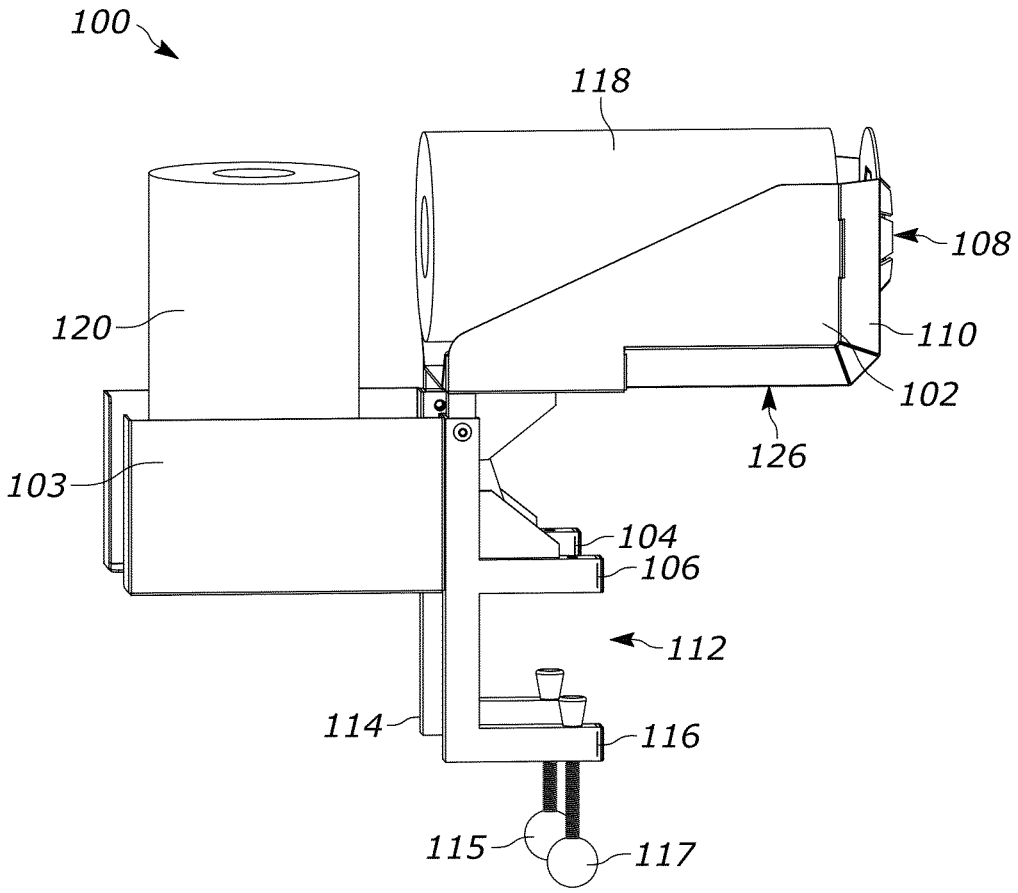
FIG. 3 is a side view of a packing material dispenser in accordance with various embodiments.
Figure 4:
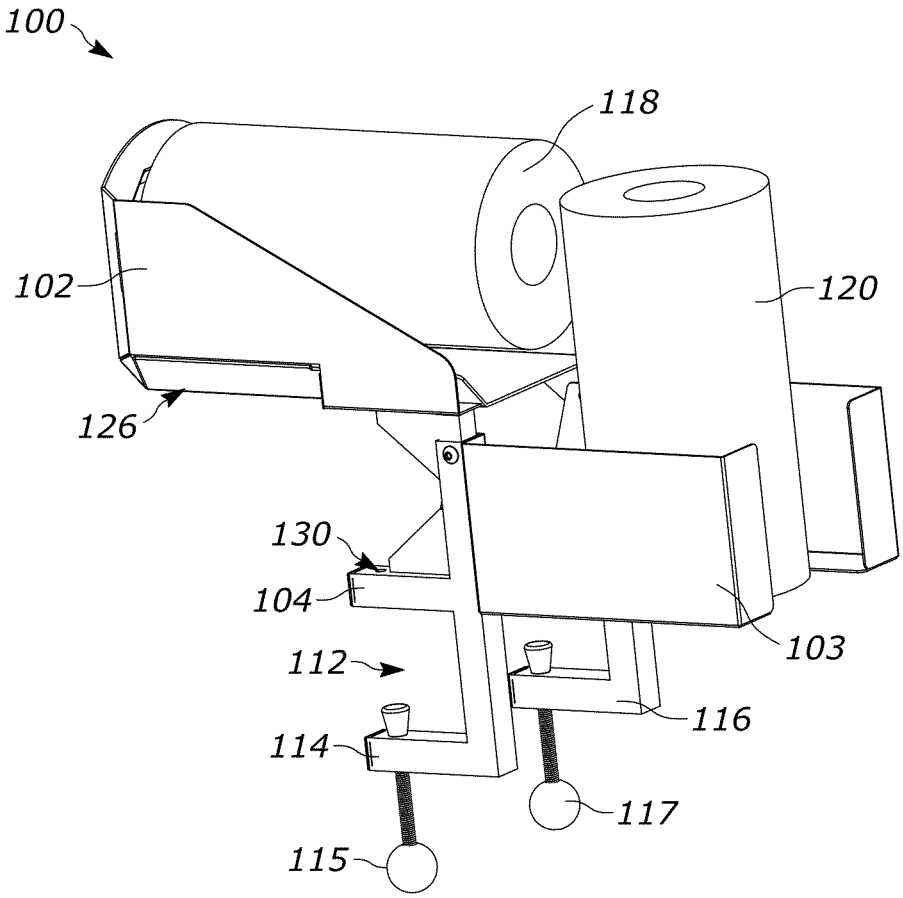
FIG. 4 is a rear perspective view of a packing material dispenser in accordance with various embodiments.
Figure 5:
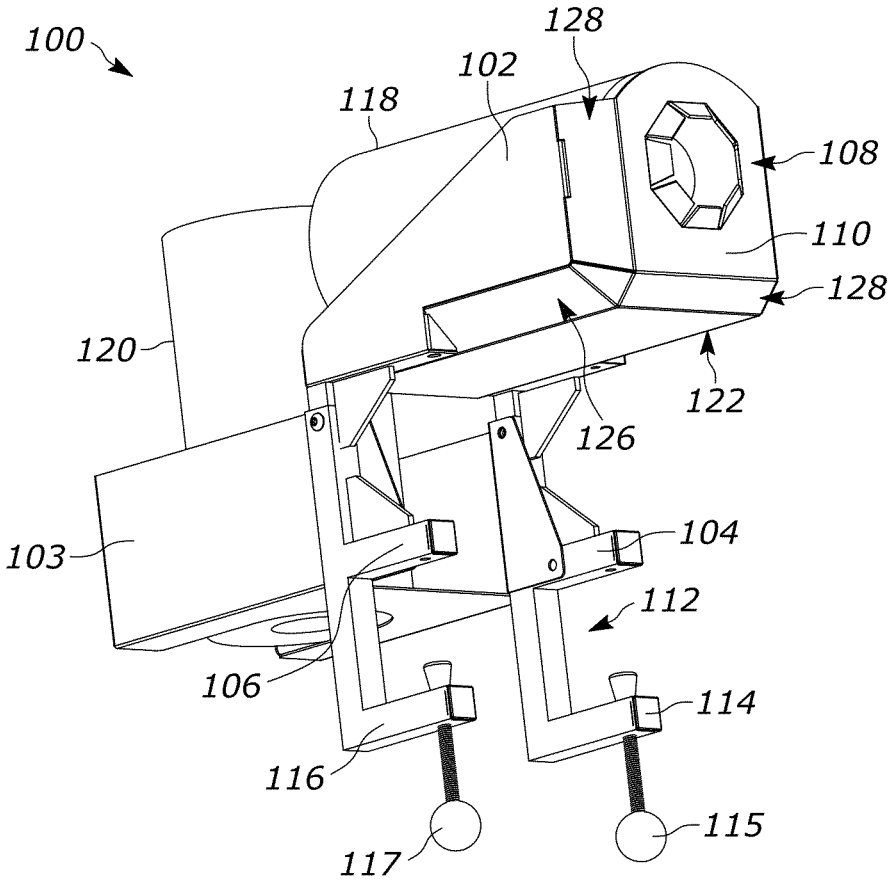
FIG. 5 is a front bottom perspective view of a packing material dispenser in accordance with various embodiments.

Skilled artisans will appreciate that elements in the figures are illustrated for simplicity and clarity and have not necessarily been drawn to scale. For example, the dimensions and/or relative positioning of some of the elements in the figures may be exaggerated relative to other elements to help to improve understanding of various embodiments. Also, common but well-understood elements that are useful or necessary in a commercially feasible embodiment are often not depicted to facilitate a less obstructed view of these various embodiments. It will further be appreciated that certain actions and/or steps may be described or depicted in a particular order of occurrence while those skilled in the art will understand that such specificity with respect to sequence is not actually required. It will also be understood that the terms and expressions used herein have the ordinary technical meaning as is accorded to such terms and expressions by persons skilled in the technical field as set forth above except where different specific meanings have otherwise been set forth herein.

DETAILED DESCRIPTION

Described herein are apparatuses that are useful for dispensing, holding, and/or storing packing material. Such apparatuses also may assist with organization of packing materials, including, such as, rolls of kraft paper used as packing materials.

Whereas storing packing materials in one location, such as a designated room, building, and/or warehouse, may cause delays in packing and/or packaging items, products, boxes, and the like, in instances where the items are stored in a different area than the packaging materials, these teachings may help avoid those delays. This may provide for an additional roll of packing material near the location of packaging. Further, by interconnecting the rolls of packing material, the time to change rolls of packing material when the first roll ends is substantially seamless, saving time and money. By providing a packing material dispenser including storage and dispensing of multiple rolls of packing material at the point of dispensing the material, delays in packaging can be shortened.

Generally speaking, pursuant to these various embodiments described herein, a packing material dispenser includes a face plate including a spout, side walls and bases to hold the rolls of packing material, and feet to support the dispenser. In one illustrative approach, the packing material dispenser includes a face plate including a spout, first side walls connected to the face plate, a first roll shelf including a first base connected to the first side walls, a second roll shelf substantially orthogonal to the first roll shelf including a connecting plate, a second base, and second side walls, wherein the connecting plate connects the second roll shelf to the first base of the first roll shelf, and feet configured to support the paper dispenser on a surface. In some instances, the second roll shelf is optional, i.e., it can be removed and/or not included such that the packing material dispenser includes just the first roll shelf.

So configured, the first roll shelf provides a location for a first roll of packing material to be placed therein; likewise, the second roll shelf provides a location for a second roll of packing material to be placed therein. By interconnecting the first roll of packing material and the second roll of packing material, time can be saved by seamlessly transitioning from the first roll to the second roll when the first roll runs out. The second roll can then readily replace the first roll when convenient for the user, and a third roll may replace the second roll. The orthogonal orientation makes for a smaller footprint for the dispenser, allowing for locating the dispenser in a wider variety of locations more convenient to a user's packing operations.

In some configurations, the packing material dispenser includes a clamping mechanism. The clamping mechanism utilizes the feet of the packing material dispenser as the top portion of a C-clamp. The clamping mechanism may include threaded rods and handles to clamp the packing material holder to an edge of the surface. By utilizing the feet or the clamping mechanism, the packing material dispenser may be placed in a variety of locations throughout a warehouse and provide localized dispensing of packing material where the packaging is occurring. Additionally, by providing a location for a second roll of packing material, the packing material dispenser provides additional storage to avoid lost time in retrieving additional packing material.

In one exemplary embodiment, the packing material dispenser, and in particular, the side walls thereof, include an angled channel at the bottom of the side walls. The angled channel provides a narrower base for the roll of packing material to sit in. In this way, the roll of packing material can more securely seat in the packing material holder and avoid rocking side to side. The angled channel may be angled such that the contact between the roll of material and the angled channel is optimized. This allows the roll of packing material to fit securely in the packing material dispenser while additionally avoiding additional friction between the angled channel and the roll of packing material. The angled channel may be angled to mirror the lower portion of the roll of packing material.

In other configurations, the face plate may include an angled portion on each side of the spout. These angled portions may be utilized with the angled portions of the side walls described above. The angled portions of the face plate may help avoid the rolls of packing material from being pulled into the back of the face plate, and as a result, binding and/or increasing the amount of friction between the packing material dispenser and the rolls of packing material. The angled portions of the face plate may also aid in properly sealing the rolls of packing material in the packing material dispenser.

Referring now to the drawings, wherein identical numerals indicate the same elements throughout the figures, FIGS. 1 to 6 illustrate an example packing material dispenser 100 in accord with some embodiments. The packing material dispenser 100 includes a face plate 110 including a spout 108. The dispenser 100 also includes first side walls 102 and a first base plate 122 coupled to the face plate 110, second side walls 103 and a second base plate 124 coupled to the first side walls 102, and feet 104 and 106 coupled to the second side walls 103. A clamping mechanism 112 is coupled to the feet 104 and 106. The packing material dispenser 100 may be metal, plastic, carbon fiber, or another material strong enough to support the weight of at least one roll of packaging material, e.g., a first roll 118 and a second roll 120.

The face plate 110 may be substantially perpendicular (i.e., perpendicular within normal manufacturing tolerances for devices of this size, typically within 5 degrees of perpendicular) to the first side walls 102, the second side walls 103, the first base plate 122, and the second base plate 124. In some configurations, the first base plate 122 may be substantially flat and house the first roll 118. In one embodiment, the first base plate 122 includes an angled channel 126 to keep the first roll 118 centered in the first base plate 122. The second side walls 103 and the second base plate 124 may be coupled to a back side of the first side walls 102 and the first base plate 122. In some configurations, the second side walls 103 and the second base plate 124 are substantially below the first side walls 102 and first base plate 122. In some configurations, the second roll shelf, including the second base plate 124 and the second side walls 103 is optional and not included as part of the packing material holder 100. So configured, the packing material dispenser 100 can be abutted against a flat surface such as a wall.

The first base plate 122 holds the first roll 118 substantially horizontal relative to the ground. The second base plate 124 holds the second roll 120 substantially vertical relative to the ground. This may reduce the overall size, and in particular, the length and height of the packing material dispenser 100, while providing storage of the second roll 120.

The spout 108 may have a conical shape, and in some configurations, the spout 108 may have a frustoconical shape. The spout 108 may include slots along the spout 108 to provide locations to tear or rip the packing material when used. The protrusions may make a substantially octagonal shape with the slots at each corner providing eight different locations and orientations for the packing material to be torn although other configurations could be used. The face plate 110 may include angled portions 128 for coupling to the first side walls 102 and to aid in holding the first roll 118 in place. In some configurations, the protrusions or slots may include a sharpened end to aid in ripping or tearing the packing material. This allows a user to pull the packing material through the spout 108 and tear the packing material at various, or all, angles. As a result, the location the packing material dispenser 100 is placed can be optimized to allow several users to use the packing material dispenser 100 at once.

In some embodiments the first base plate 122 and the second base plate 124 are disposed apart from one another in such a way to align the middle of the first roll 118 with the top of the second roll 120. For example, if the rolls of material have a length of about 15 inches long and a diameter of approximately 8 inches wide, the second base plate 124 would be disposed about 11 inches below the first base plate 118 in order to align the middle of the first roll 118 with the top of the second roll 120. As another example, if the rolls of material have a length of about 12 inches long and a diameter of approximately 6 inches wide, the second base plate 124 would be disposed about 9 inches below the first base plate 118 in order to align the middle of the first roll 118 with the top of the second roll 120. Without being limited to a particular example, it is contemplated that the base plates can be disposed 4 to 16 inches apart from one another. In doing so, the first roll 118 and the second roll 120 may be readily interconnected by connecting a last portion of the first roll 118 to a first to be used portion of the second roll 120, which allows for the continuous pulling of packing material once the first roll 118 is empty. By providing a packing material dispenser 100 including multiple rolls of packing material adjacent to one another and linked together, space for dispensing the packing material can be saved and maximized. Additionally, by providing orthogonal storage of multiple roles for example, on a shelf, a narrower shelf can be utilized over a dispenser having the rolls lined up end to end.

Figure 6:
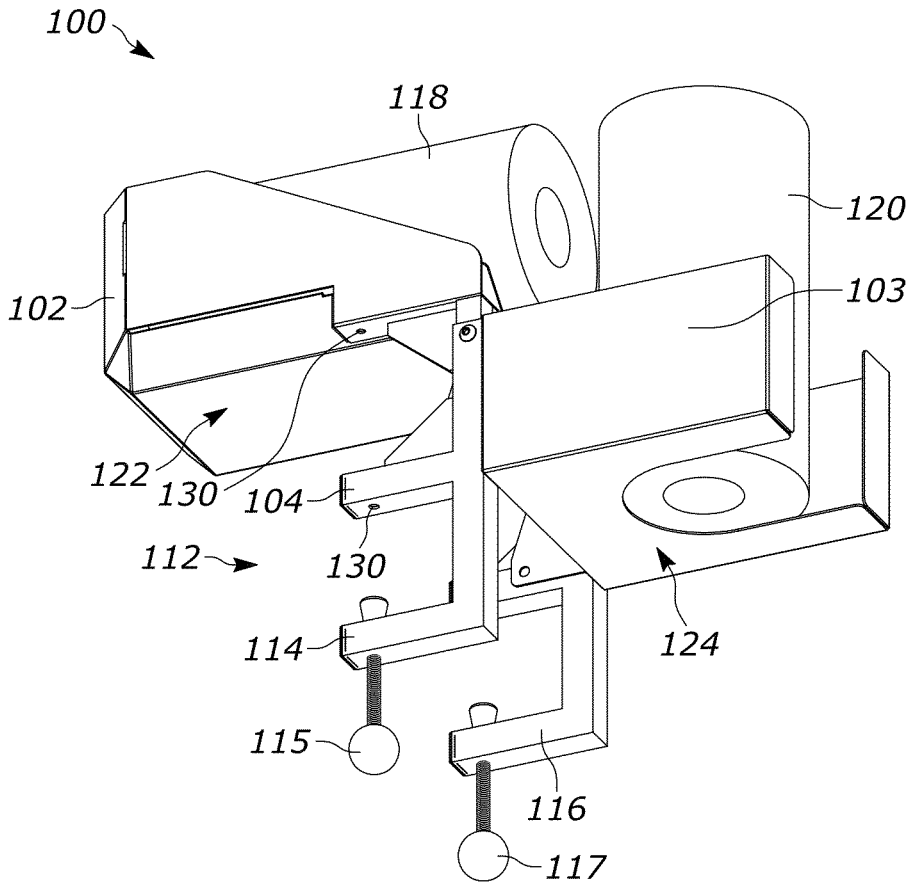
FIG. 6 is a rear bottom perspective view of a packing material dispenser in accordance with various embodiments.

In some embodiments, the packing material dispenser 100 includes various fastener openings 130. For example, as shown in FIG. 6, the first base plate 122 and the feet 104 and 106 include openings 130 configured to be used with a fastener. In this way, the packing material dispenser 100 may be secured onto a surface. This permits the further securement of the packing material dispenser 100 in addition to the clamping mechanism 112. Alternatively, the fastener openings 130 may permit the use of the packing material dispenser 100 without the use of the clamping mechanism 112. In this way, the packing material dispenser 100 could be utilized without the clamping mechanism 112 and, in some instances, without the existence of the clamping mechanism 112 on the packing material dispenser 100. The second base plate 124 may be substantially in line with or disposed just above the bottom of the feet 104 and 106 to permit a tabletop/benchtop use of the packing material dispenser 100. Because of this, the packing material dispenser 100 can be fastened onto a benchtop while maintaining the capability of including both rolls of packing material.

The packing material dispenser 100, and in particular the clamping mechanism 112, include c-clamps 115 and 117. The c-clamps 115 and 117 include threaded rods and handles. The threaded rods are fed through legs 114 and 116 respectively. In this way, the packing material dispenser 100 can be placed over an end or edge of a surface, such as a table, and the c-clamps 115 and 117 can be tightened through the legs 114 and 116 and secure the packing material dispenser 100 to the table between the end of the c-clamps 115 and 117 and the legs 104 and 106. The c-clamps 115 and 117 also allow for the quick securement and movement of the packing material dispenser 100 to various surface and locations.

The angled channels 126 of the first base plate 122 may be angled upward at angle of about 120-150 degrees from the base plate 122. In some embodiments, the angled channel 126 may extend at an angle of approximately 135 degrees from the first base plate 122. As noted above, the angle of the angled channel 126 may be optimized to allow for sufficient contact on the first roll 118 to avoid rocking of the roll in the packing material dispenser 100 while minimizing the amount of friction imparted on the first roll 118 by at least the angled channel 126 and, in some instances, the packing material dispenser 100 as a whole. The angled channel 126 creates a narrower channel for the bottom of the first roll 118 to be placed in. Due to varying sizes of rolls of packing material, the angled channel 126 may be stepped in some instances. In this way, the packing material dispenser 100 may be capable of optimizing the secure fit of the roll within the dispenser while limiting the amount of friction between the roll and dispenser, while being capable of being used with different sized rolls of packing material.

Similarly, the angled portions 128 of face plate 110 may be angled outward at angle of about 120-150 degrees from the face plate 110. In some embodiments, the angled portions 128 may extend at an angle of approximately 135 degrees from the face plate 110. As noted above, the angle of the angled portions 128 may be optimized to allow for sufficient contact on the first roll 118 to avoid rocking of the roll in the packing material dispenser 100 while minimizing the amount of friction imparted on the first roll 118 by at least the angled portions 128 and the face plate 110 and, in some instances, the packing material dispenser 100 as a whole. The angled portions 128 creates a narrower opening for the end of the first roll 118 to be dispensed from and can avoid having the entire end of the roll abutting the face plate 110 and creating additional friction.

Due to the shape of the packing material dispenser 100, and in particular the spout 108 configured to allow tearing along the entire periphery thereof, the packing material dispenser 100 may be used by multiple users placed at various locations around the packing material dispenser 100. By providing obtuse angled edges, such as, for example, the angled channel 126 and angled portions 128, 90 degree edges are avoided, which, when the packing material dispenser 100 is constructed of metal, such as bent sheet metal, could scrape a user or snag clothing. Additionally, the angled channel 126 and angled portions 128 additionally allow for the use of less material when manufacturing the packing material dispenser 100.

In use, at least a first roll of packing material and a second roll of packing material is deposited into a packing material dispenser. The first roll of packing material and the second roll of packing material are substantially perpendicular (within 30 degrees of perpendicular) relative to one another. The rolls of packing material may come interconnected, if not, the first roll of packing material and the second roll of packing material may be interconnected, for example, by taping or some other connection. Once interconnected, a portion of packing material is pulled through a spout of the packing material dispenser. The portion of the packing material pulled from the packing material dispenser is torn to be placed inside of a package.

The terms and expressions used herein have the ordinary technical meaning as is accorded to such terms and expressions by persons skilled in the technical field as set forth above except where different specific meanings have otherwise been set forth herein. The word "or" when used herein shall be interpreted as having a disjunctive construction rather than a conjunctive construction unless otherwise specifically indicated. The terms "coupled," "fixed," "attached to," and the like refer to both direct coupling, fixing, or attaching, as well as indirect coupling, fixing, or attaching through one or more intermediate components or features, unless otherwise specified herein.

The singular forms "a", "an", and "the" include plural references unless the context clearly dictates otherwise.

Approximating language, as used herein throughout the specification and claims, is applied to modify any quantitative representation that could permissibly vary without resulting in a change in the basic function to which it is related. Accordingly, a value modified by a term or terms such as "about", "approximately", and "substantially", are not to be limited to the precise value specified. In at least some instances, the approximating language may correspond to the precision of an instrument for measuring the value, or the precision of the methods or machines for constructing or manufacturing the components and/or systems. For example, the approximating language may refer to being within a 10 percent margin.

What is claimed:

1. A dispenser comprising:

a face plate including a spout having a conical shape;

first side walls connected to the face plate;

a first roll shelf including a first base connected to the first side walls, the first roll shelf is configured to support a first roll of material along a length of the first roll;

a second roll shelf including a second base and second side walls;

at least one support member supporting the second roll shelf relative to and connected to a portion of the first base of the first roll shelf opposite of the face plate, the second roll shelf configured to support a second roll of material on an end of the second roll; and feet configured to support the dispenser on a surface, wherein the feet extend from the at least one support member parallel relative to the first base and extend towards the face plate, wherein the feet are disposed at a rearward end of the first roll shelf.

2. The dispenser of claim 1 further comprising a clamping mechanism configured to clamp the surface between the clamping mechanism and a bottom surface of the feet to secure the dispenser to an edge of the surface.

3. The dispenser of claim 2 wherein the clamping mechanism comprises threaded C-clamps supported by legs having openings which the threaded C-clamps extend therethrough.

4. The dispenser of claim 1 wherein the first base and the second base are disposed substantially parallel to one another and are connected by the at least one support member, which extends substantially perpendicular to the first base and the second base.

5. The dispenser of claim 1 wherein the at least one support member includes a length separating the first base from the second base such that an opening of the first roll of packaging material aligns with a top of the second roll of packaging material to allow an end of the first roll of packing material is connected to a beginning of the second roll of packing material such that when the end of the first roll of packing material is pulled through the spout, a beginning of the second roll of packing material is pulled through the spout.

6. The dispenser of claim 1 wherein the conical shape is a frustoconical shape.

7. The dispenser of claim 1 wherein the spout extends outward from the face plate.

8. The dispenser of claim 1 wherein the spout is shaped to allow packing material to be pulled therethrough.

9. The dispenser of claim 1 wherein the at least one support member supports the second base plate at between 9 to 11 inches below the first base.

10. The dispenser of claim 1 wherein the first base and the first side walls are connected at an angle between 120-150 degrees forming an angled channel.

11. The dispenser of claim 1 wherein the first base and the first side walls are connected at an angle of about 135 degrees forming an angled channel.

12. The dispenser of claim 1 wherein the face plate and the first side walls are connected at an angle between 120-150 degrees.

13. The dispenser of claim 1 wherein the face plate and the first side walls are connected at an angle of about 135 degrees.

14. The dispenser of claim 1 wherein the first roll shelf includes fastener openings.

15. The dispenser of claim 1 wherein the feet include fastener openings.

16. The dispenser of claim 1 wherein the spout includes slots disposed around a periphery of the spout, wherein the slots are configured to tear packing material disposed within the dispenser.

17. The dispenser of claim 1 wherein the feet are disposed below the second roll shelf.

18. The dispenser of claim 1 wherein the feet are substantially in line with the second roll shelf.

19. A method comprising:

depositing a first roll of packing material and a second roll of packing material into the dispenser of claim 1, wherein the first roll of packing material and the second roll of packing material are substantially orthogonal relative to one another;

interconnecting the first roll of packing material and the second roll of packing material;

pulling a portion of packing material through a spout of the packing material dispenser; and tearing the portion of the packing material from the packing material dispenser to be placed inside of a package.

20. The method of claim 19 further comprising:

pulling a final portion of packing material of the first roll through the spout of the packing material dispenser, which pulls a first portion of packing material of the second roll through the spout.

* * * * *